US010301099B2

(12) United States Patent
Carolan et al.

(10) Patent No.: US 10,301,099 B2
(45) Date of Patent: May 28, 2019

(54) PACKAGE OF TREATMENT MATERIAL HEATED BY MICROWAVE

(71) Applicants: Sean Carolan, Vancouver (CA); Tianna Jaisaard, Vancouver (CA)

(72) Inventors: Sean Carolan, Vancouver (CA); Tianna Jaisaard, Vancouver (CA)

( * ) Notice: Subject to any disclaimer, the term of this patent is extended or adjusted under 35 U.S.C. 154(b) by 1099 days.

(21) Appl. No.: 14/163,693

(22) Filed: Jan. 24, 2014

(65) Prior Publication Data

US 2014/0216960 A1 Aug. 7, 2014

Related U.S. Application Data

(60) Provisional application No. 61/758,412, filed on Jan. 30, 2013.

(51) Int. Cl.

| | |
|---|---|
| ***A61Q 5/00*** | (2006.01) |
| ***B65D 25/00*** | (2006.01) |
| ***B65D 25/54*** | (2006.01) |
| ***B65D 75/58*** | (2006.01) |
| ***B65D 81/34*** | (2006.01) |

(52) U.S. Cl.

CPC ..... *B65D 81/3446* (2013.01); *A61Q 5/00* (2013.01); *B65D 25/00* (2013.01); *B65D 25/54* (2013.01); *B65D 75/5822* (2013.01); *B65D 81/3415* (2013.01); *B65D 81/3461* (2013.01)

(58) Field of Classification Search

CPC ..... A61Q 19/00; A61Q 5/00; A61K 2800/87; A61K 8/922; A61K 36/00

See application file for complete search history.

(56) References Cited

U.S. PATENT DOCUMENTS

| | | | | |
|---|---|---|---|---|
| 5,410,857 | A * | 5/1995 | Utley | B31B 19/82 156/267 |
| 5,891,116 | A * | 4/1999 | Mast | A41D 19/0055 604/290 |
| 5,916,573 | A | 6/1999 | Spiers et al. | |
| 6,136,329 | A * | 10/2000 | Boratyn | A61K 8/975 424/401 |
| 8,613,732 | B2 | 12/2013 | Montrose | |
| 2003/0152296 | A1* | 8/2003 | Huffer | B65D 33/2591 383/64 |
| 2003/0211177 | A1* | 11/2003 | Pineda | A61K 8/922 424/727 |
| 2004/0069157 | A1* | 4/2004 | Lin | B65D 33/01 99/451 |
| 2005/0258172 | A1 | 11/2005 | Gueret | |
| 2009/0068128 | A1* | 3/2009 | Waddington | A61K 8/673 424/59 |
| 2011/0081372 | A1 | 4/2011 | Gervasio | |
| 2013/0096515 | A1* | 4/2013 | Montrose | A61K 8/31 604/290 |

* cited by examiner

*Primary Examiner* — Mark V Stevens

(74) *Attorney, Agent, or Firm* — Adrian D. Battison; Ade & Company Inc.; Ryan W. Dupuis

(57) ABSTRACT

An apparatus for treatment of a body part such as the hair of a user which includes a treatment material such as coconut oil contained as a single portion within a closed and sealed flexible pouch formed of a flexible laminated plastic material which is foil free so that it can be heated in a microwave oven to warm the treatment material to a required temperature. The pouch includes printed instruction material comprising instructions to warm the material in a microwave oven, to knead the product when heated within the closed pouch and to re-heat in stages to the required temperature and to form an opening in the pouch and apply the warmed treatment material.

9 Claims, 1 Drawing Sheet

PACKAGE OF TREATMENT MATERIAL HEATED BY MICROWAVE

This application claims the benefit under 35 USC 119(e) of Provisional Application 61/758,412 filed Jan. 30, 2013.

This invention relates to a method for or an apparatus for a treatment of the consumer's body for example of hair using a heated treatment product.

BACKGROUND OF THE INVENTION

Treatments of various types are known using a material which is heated.

The purpose of warming the material is to benefit the body part concerned, and/or to make the treatment easier, more effective, more efficient, more affordable and more convenient with the added element of instant heat. For example, it is widely known that heat is desirable in order for oils and other formulas to actually penetrate the hair shaft. Heat is widely considered synonymous with absorption or penetration, with another example being massage oils, which are typically heated before application to the skin and body. This can also be evidenced in anti-aging skin treatments, where heat assists formulas to penetrate deeper into the skin, helping to stimulate and enhance collagen production. Hands and feet are traditionally hot-soaked before treatment, so as to soften skin, nails and cuticles for esthetic treatment.

As a replacement for professional spa/esthetic treatment-services, there exists the traditional do-it-yourself ("DIY") method where the user heats up a beauty treatment formulation themselves, at home for example. To do so, typically the user requires an oven or a stove, as well as a pot or pan, and utensils such as a spoon or spatula. Alternatively the user can possibly use an electric wax pot, or electric crock pot, along with utensils. The user can also use a microwave oven to heat up a beauty treatment formulation, but a microwave-safe bowl or cup or similar vessel is required, as well as utensils such as a spoon or spatula. Typically all of these traditional methods also require running water, a sink and/or dishwasher, and detergent, for clean-up.

Manually performing any/all of the above described DIY traditional method can be tedious, complicated, and messy; requiring significant effort. The user also has to physically perform cleanup afterward, for example dishwashing.

Manually performing all of the aforementioned DIY traditional method can be time consuming; as an example, it would not be uncommon for the user to spend an hour or more at it.

In addition to the cost of equipment, the DIY traditional method typically involves purchasing bulk quantities of ingredients from which to create formulations, which could prove to be capital-intensive.

With DIY treatments being cumbersome and prohibitive in the many ways listed above, it is not uncommon that many people opt to go to a salon and pay sums of money in professional service fees for similar heated beauty treatments.

DIY traditional heated treatments can spill, percolate, spray, melt, vaporize, bubble up or boil over causing a mess and even permanent damage to the heating system.

The DIY traditional method gives little or no guidance when it comes to formulations, heating times, heating instruments and apparatus, as well as actual dispensing/application of a heated formulation/treatment; all of which present significant, problematic safety concerns; ranging from potential burn injuries, to fires or even explosion.

SUMMARY OF THE INVENTION

According to the invention there is provided a method for treatment of a part of a body of a user comprising:

providing a treatment material in a closed package;

heating the package in a microwave oven to warm the treatment material to a temperature above room temperature;

forming an opening in the package;

and applying the warmed treatment material to a part of the body of the user.

According to the invention there is provided an apparatus for treatment of a part of a body of a user comprising:

a treatment material;

a closed package containing the treatment material;

the package being formed of a material which can be heated in a microwave oven to warm the treatment material to a temperature above room temperature;

and an instruction material associated with the package comprising instructions to warm the material in a microwave oven and to form an opening in the package and apply the warmed treatment material to a part of the body of the user.

The package is preferably flexible but may be rigid or stiff, or may have rigid components as part of a package which is otherwise flexible.

The package is preferably formed of a flexible plastics layer or film rather than as a stiff layer, thus allowing the treatment material to be manipulated or kneaded within the package.

The package is preferably formed of two overlying sheets connected at along their side edges to form a pouch, but other shapes are also possible, particularly if stiff or semi stiff parts are included.

In one example the treatment material is arranged for treatment of the hair. However many other treatment materials can be provided in this way as set out hereinafter. In particular as one preferred example the material may be formulated for treatment of the face as a beauty treatment. The treatment material can preferably be of an organic nature.

Preferably the treatment material is arranged to be left in place for a treatment period.

In one example the treatment material is arranged such that it is in solid condition when at room temperature and is liquid when warmed.

In some cases the treatment material comprises an oil such as coconut oil or coconut oil in admixture with other natural oils. However many other treatment materials can be formulated to be used in this invention.

Preferably the instruction material contains instructions for the user to knead the unopened treatment material or otherwise engage the material in the hands to check for a required temperature. This enables the user to determine a temperature that has been reached to avoid application of dangerously hot material to the body.

In this case the instruction material may contain instructions for the user to re-heat the treatment material in additional increments.

Preferably the instruction material contains instructions, as an alternative to the microwave heating system, if so desired, for the user to heat the treatment material in the unopened package by submersing in hot water.

Preferably the package includes an indication of an opening location.

Preferably the flexible package is formed of a flexible plastics material which is arranged to be kept sealed and does not get opened, punctured or pierced prior to inserting into the microwave oven Preferably the package is flexible.

In some cases the flexible package includes a built-in spout.

In some cases the flexible package is re-sealable.

In some cases the package includes a transparent window for viewing of its contents for example during the heating process and before application.

Where the package is formed as a flexible pouch formed from a film, preferably the film is formed of a plastics material which is foil-free.

Preferably the film is Bisphenol A (BPA)-free.

In some cases the film has an oxygen transfer rate (OTR) for it to be heated correctly and consistently in a microwave oven.

Preferably the film is a laminate of plastics layers.

Preferably the film is a laminate of a polyester film and polyethylene film.

Preferably the film includes reverse printing inside of the laminated film.

In one embodiment the package contains a single portion of the treatment material for one time use.

The present invention therefore provides the world's first microwaveable, heated beauty treatment, incorporating the world's first instant hot oil, hair treatment. Thus there is provided a package such as a flexible plastic pouch, packet, bag or tube which is inserted into a microwave oven for a required time for the purpose of heating its contents. The contents are then applied as a treatment to the body of the user at any suitable location such as the hair, scalp, face, (including skin, cheeks, chin, forehead, temples, eyebrows, eyelashes, eyelids, ears, nose, lips, mouth, teeth), or body parts such as neck and throat, arms, legs, elbows, knees, hands, fingers, feet, toes, shoulders, chest, armpits, abdomen, back, buttocks, groin/crotch, finger nails or toe nails.

The package contents could include but is not limited to: natural oils (i.e. coconut oil, olive oil, argan oil, avocado oil, jojoba oil, kukui oil, macadamia oil, amla oil etc.) vitamins (i.e. vitamin A, vitamin E, vitamin C, vitamin D, etc.) minerals with one example being clay minerals, proteins, plants with one example being aloe, herbs, extracts with one example being coconut fruit extract, botanicals, fragrances, henna, colors, colorants with one example being hair color, conditioners with one example being hair conditioner, fragrance oils, essential oils, formulations, waxes with one example being paraffin wax, algae with one example being sea kelp, lotions, creams, gels, serums, pastes, muds, clays, baking soda, flour, powders, liquids, sugars, syrups, water with one example being coconut water, milk products with one example being coconut milk, fruit products with one example being banana, butters with one example being coconut butter, honey, egg whites, egg yolks, and any blend(s) thereof.

Once heated, the consumer takes the package out of the microwave oven and kneads it in their hands to check for desired temperature. If required, the package can be reheated in additional increments, until desired temperature is reached. The consumer then opens the package at a location as indicated on the package, and squeezes it to apply its heated contents to the required body part for treatment, pre-treatment or post treatment purposes. One example of a treatment could be a hot oil hair treatment. One example of a pre-treatment could be a hot wax treatment for hair removal. One example of a post treatment could be a skin soothing and moisturizing treatment for irritated skin following hair removal.

The package may have the following characteristics:

- does not require opening, puncturing or piercing prior to inserting into microwave oven.
- may or may not contain a built-in spout for pouring/applying.
- may or may not be re-sealable.
- may or may not contain a transparent window for which to view its contents.
- its contents may also be heated by submersing unopened package in hot water in a heat-safe vessel such as a mug, bowl, pot, pan, sink etc., or submersing in running water, for a matter of seconds for example 30-60 seconds.
- provides microwave-safe and waterproof printed directions for safe use.
- is plastic-based and foil-free, meaning it does not contain any metal foil.
- does not leak before or after heating.
- may be a variety of shapes including circular, rectangular and tailored shapes.
- is Bisphenol A (BPA)-Free.
- is non-aerosol.
- is a disposable application package which may or may not be single use.

The present invention solves the equipment requirements by eliminating virtually all of them: requiring no oven or stove, no pots or pans, no utensils, no electric wax pot, or electric crock pot, no microwave-safe bowls, cups or similar vessels; nor does it require running water, a sink and/or dishwasher, or detergent; as it is a complete, ready-made, generally single use, disposable package.

The present invention solves the labor/effort requirement problem because it is instant by design, is uncomplicated, and needs zero preparation as well as zero clean up.

The present invention solves the time requirement problem because: 1) there is no preparation involved, 2) one can simply pop it in the microwave for just a matter of seconds to heat, 3) walk away from an already clean kitchen or salon prep area requiring no further time for clean-up.

The present invention solves the travel requirement problem because it is a sealed flexible package, which is non-aerosol and virtually unbreakable, and as such, packs or travels well within luggage or carry-on luggage. It requires nothing more than a microwave oven, or optional hot water, for it to be heated and applied regardless of location.

The present invention solves the capital cost requirement problem as a result of its pre-factored, complete single-serving treatments, offering little-to-no waste, similar to portion control in diets.

The present invention may solve the problem of the difficulty of DIY type products because for the first time, a person can quickly, conveniently, effectively, and affordably, do it themselves. Thus the present invention solves this by being fully sealed and remaining unopened at all times while in the microwave oven; and the package comes with clear directions for safe microwave heating; and the package is also 100% foil-free so as to avoid any and all sparking, and/or arcing within the microwave oven, thus eliminating the microwave mess/damage problem.

The present invention solves safety problems in a number of ways: the formulations can be thoroughly tested, and by way of example, are preferably fully compliant with both the FDA in the United States, and Health Canada. The present invention can be provided with clear directions for safe use, printed on the actual package, which fall well within standard product liability insurance parameters/requirements. The directions for safe use also call for incremental heating in the interests of safety, and also offer a safe heat-check method, by kneading heated unopened package in hands prior to any application. Additionally, the present invention has the option of a built-in spout for safe, pressure-regulated pouring/applying.

The DIY traditional method can involve using loose, unsealed ingredients in a formulation which would be difficult to heat using hot water. The present invention solves this problem because it is fully sealed and remains unopened at all times while the flexible package is simply submersed in hot water.

The following list represents some, but is not limited to all, of the possible heated beauty treatment applications:

Hair treatments: cleansing, masks, muds, hot oil hair treatments, conditioning (including deep conditioning and intense conditioning), leave-in conditioning, coloring, color removal, straightening, curling, leave-in treatments, shine and/or polish, damage (repair) treatments (including color, bleach and heat damage).

Face treatments: skin cleansing, skin toning, skin moisturizing, skin exfoliation, skin anti-aging, skin firming, skin tightening, pore size reduction, skin smoothing, skin softening, skin glowing, skin puffiness, massage, acne, sun spots, dark circles, rosacea, psoriasis, eczema, bronzer with an example being self-tanning, skin (pigmentation) lightening, skin scar repair, hair removal, ingrown hairs.

Scalp treatments: cleansing, toning, moisturizing, dandruff, psoriasis, eczema, conditioning (including deep conditioning and intense conditioning), leave-in conditioning, smoothing, softening, exfoliation, massage, sun spots, bronzer with an example being self-tanning, skin (pigmentation) lightening, skin scar repair, hair removal, ingrown hairs.

Eyelash treatments: growth, thickeners, coloring and color tinting, curling, conditioning (including deep conditioning and intense conditioning), leave-in conditioning, color removal, straightening, leave-in treatments.

Eyebrow treatments: growth, thickeners, thinners, coloring and color tinting, waxing/shaping, conditioning (including deep conditioning and intense conditioning) psoriasis, eczema, bronzer with an example being self-tanning, hair removal, ingrown hairs, damage (repair) treatments (including color, bleach and heat damage), skin scar repair.

Eye lid treatments: fatigue, swelling, puffiness, cleansing, moisturizing, toning, anti-aging, skin firming, skin tightening, skin smoothing, skin softening, skin glowing, sun spots, rosacea, psoriasis, eczema, bronzer with an example being self-tanning, skin (pigmentation) lightening, skin scar repair.

Ear treatments: skin cleansing, skin toning, skin moisturizing, skin exfoliation, skin anti-aging, skin firming, skin tightening, skin smoothing, skin softening, skin glowing, sun spots, rosacea, psoriasis, eczema, bronzer with an example being self-tanning, skin (pigmentation) lightening, skin scar repair, hair removal, ingrown hairs.

Nose treatments: skin cleansing, skin toning, skin moisturizing, skin exfoliation, skin anti-aging, skin firming, skin tightening, pore size reduction, skin smoothing, skin softening, skin glowing, acne, sun spots, rosacea, psoriasis, eczema, bronzer with an example being self-tanning, skin (pigmentation) lightening, skin scar repair, hair removal, ingrown hairs.

Shoulder treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Chest treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Back treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Arm treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Armpit treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Abdomen treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Elbow treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, pre-treatment softening, hair removal, ingrown hairs.

Leg treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Buttocks treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Groin/crotch treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Knee treatments: skin cleansing, skin toning, skin moisturizing, skin exfoliation, skin anti-aging, skin firming, skin tightening, skin smoothing, skin softening, skin glowing, massage, acne, sun spots, rosacea, psoriasis, eczema, bronzer with an example being self-tanning, skin (pigmentation) lightening, skin scar repair, hair removal, ingrown hairs.

Nail treatments: (hot wax topical product) for pedicures, manicures, as well as nail strengthening, hardening, pre-treatment softening, anti-fungal.

Hair removal: (hot wax/topical product) for hair removal: facial hair, scalp, eyebrows, ears, nose, shoulders, chest, back, arms, armpits, hands, feet, neck and throat, abdomen, elbows, legs, buttocks, groin/crotch, knees, bikini lines.

Lip treatments: cleansing, toning, moisturizing, exfoliation, anti-aging, firming, smoothing, softening, glowing, sun spots, psoriasis, eczema, scar repair, plumping, fullness, shaping, contouring.

Hand treatments: skin cleansing, skin toning, skin moisturizing, skin exfoliation, anti-aging, skin firming, skin tightening, skin smoothing, skin softening, skin glowing, massage, sun spots, psoriasis, eczema, bronzer with an example being self-tanning, skin (pigmentation) lightening, skin scar repair, pre-treatment softening, hair removal, ingrown hairs, calluses.

Foot treatments: skin cleansing, skin toning, skin moisturizing, skin exfoliation, anti-aging, skin firming, skin tightening, skin smoothing, skin softening, skin glowing, massage, sun spots, psoriasis, eczema, bronzer with an example being self-tanning, skin (pigmentation) lightening, skin scar repair, pre-treatment softening, hair removal, ingrown hairs, calluses, corns, bunions.

Neck and Throat treatments: skin cleansing, skin toning, skin moisturizing, skin exfoliation, anti-aging, skin firming, skin tightening, skin smoothing, skin softening, skin glowing, massage, acne, sun spots, psoriasis, eczema, bronzer with an example being self-tanning, skin (pigmentation) lightening, skin scar repair, hair removal, ingrown hairs.

Teeth Treatments: whitening or bleaching.

One of the challenges of the invention was the packaging material. Most flexible packages today are made of either foil (usually aluminum) or metallized film, with an example being metallized polyester. This is primarily because of extended shelf life which is a huge concern for manufacturers. Foils and metallized films have become industry-standard because they are able to extend product shelf life, as they have very high barriers to water (moisture), UV light and oxygen (gases).

Aluminum foil for example, has an oxygen transfer rate (OTR) of zero, meaning it provides a 100% barrier to all moisture, oxygen and light. And while metallized foil is slightly less, it is still has excellent barrier qualities and creates essentially an airtight package which not only preserves raw shelf life from rancidity, spoilage and the like, it also preserves freshness as well as aroma.

Other reasons for foils and metallized foils being so popular for flexible packaging, is because of their rigidity. Flexible pouches, gusseted pouches, zippered pouches, even flexible drink packages are able to inherently stand upright much better than plastic flexible packages because of the structural rigidity qualities of foil and metallized film; which is desirable for many point of purchase scenarios.

That same rigidity also provides excellent printability and graphics for flexible packaging; where actual print quality is a real challenge in the flexographic printing industry. In addition to the foregoing, foils and especially metallized film as materials have become quite inexpensive as a result of their popularity and wide availability.

Oxygen Transfer Rate (OTR) is the amount of Oxygen that passes through a defined area of film over a 24 hour period, measured in cubic centimeters (cc) to either one square meter or 100 square inches over a 24 hour period. (cc/M2/24 hours) or (cc/100 square inches/24 hours).

Given all of the apparent advantages of foil and/or metallized film, unfortunately it cannot be used in microwave ovens as it will spark, arc, and is therefore a potential fire hazard, not to mention it can cause permanent damage to a microwave oven as well as its contents. This presented another challenge.

Objects of the present invention which may be provided by the arrangement described herein are as follows

- a flexible package that can safely be heated in a microwave oven, and not be hazardous in any way, for the above noted reasons. This meant the present invention is unable to use any foil or metallized films.
- a package that has a suitable, more relaxed, oxygen transfer rate (OTR) for it to heat correctly and consistently in a microwave oven.
- a package that can offer an optional transparent window in its front principal display panel, to provide a view to its actual contents inside, which provides another factor that would not be possible with foils or metallized films.
- a package which can be heated consistently and correctly in a microwave, without opening, puncturing or piercing the package prior to inserting into microwave oven.
- a package that does not leak before and after heating.
- a package formed of flexible plastic material that provides some structural rigidity in order for the flexible package to be able to stand upright to some degree, for point of purchase (marketing/visibility) reasons, shipping reasons, as well as print quality/printability.
- a flexible package which provides an optional built-in spout for pouring/applying its heated contents.
- a flexible package which could include a re-sealable option.
- a flexible package which provides microwave-safe and waterproof printed "Directions for Safe Use" on the actual package.
- a flexible package which is Bisphenol A (BPA)-Free.
- a flexible package which can be safely, correctly and consistently heated by submersing in hot water (in a heat-safe vessel such as a mug, bowl, pot, pan, sink etc.), or in running water, in a matter of seconds for example 30 to 60 seconds, without opening, puncturing or piercing the package prior to hot water submersion; and which would not leak before and after heating.

Through much research and development, the present invention created a plastic-based flexible package which met all of the above criteria. It is a flexible, laminated plastic package, which is completely foil-free.

It incorporates polyester film and polyethylene film which are laminated together.

It offers a suitable oxygen transfer rate (OTR) for microwave heating as well as hot water heating, yet still offers a good barrier for shelf life considerations.

It incorporates reverse printing inside of the laminated film, with what is known as an ink trap in the flexographic printing industry; yielding a microwave-safe, UV safe, and waterproof printed package with directions for safe use which cannot be worn off or rubbed off.

Being foil-free and therefore transparent, the present invention is able to offer the optional transparent window in its front principal display panel, to provide a view to its actual contents inside.

Because of its OTR, the package can be heated consistently and correctly in a microwave, without opening, puncturing or piercing the package prior to inserting into microwave oven.

It also does not leak before or after heating. Although foil-free, because of the lamination, the plastic film provides good rigidity to the package, for its ability to stand upright as well as print sharply where graphics are concerned.

The package is Bisphenol A (BPA)-Free, and does offer an optional built-in spout for pouring/applying its heated contents.

DETAILED DESCRIPTION

Figure 1:
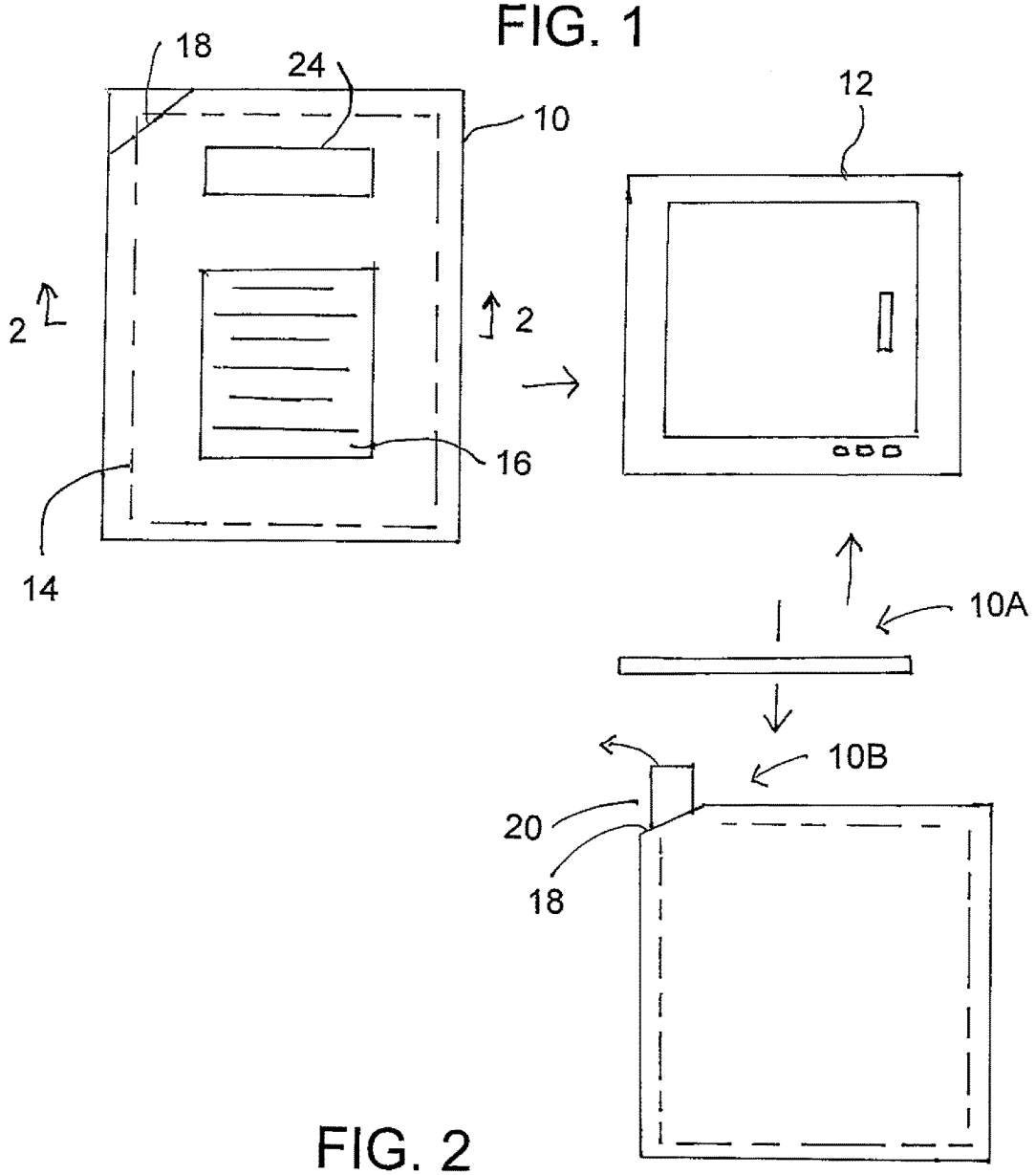
FIG. 1 is a schematic illustration of the step of the method of use of the present invention.
Figure 2:
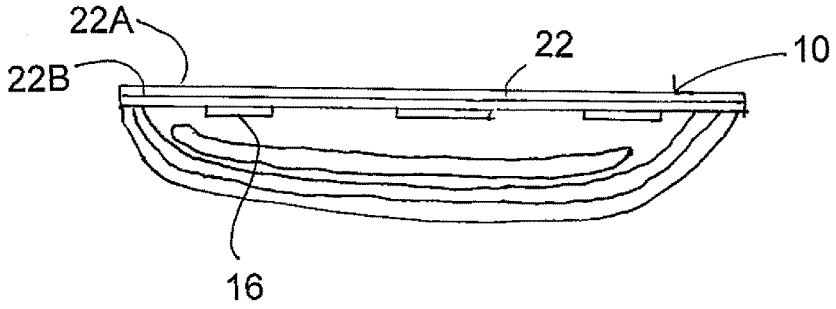
FIG. 2 is a cross-section along the lines 2-2 of FIG. 1.

A microwaveable flexible package 10 in the form of a pouch or packet, formed of a microwave safe material which can tolerate the required temperatures and the heating action is inserted into a microwave oven 12 for a matter of seconds for example 20-30 seconds for the purpose of warming its contents. The pouch is formed of a plastics material which is impermeable to its contents. The pouch is sealed at 14 around the edges. Any suitable shape can be used including circular, rectangular and tailored shapes.

The contents typically are maintained at a storage temperature which is typically room temperature of the order of 18 to 25 degrees C. However some products may be stored in refrigeration so that the initial temperate is lower. In most cases the product is heated only to a warm temperature of the order of 25 to 30 degrees C.

At these temperatures the preferred material of coconut oil is solid at the storage temperature and liquid at the warmed temperature. When solid the pouches can be readily packaged in a box or the like, stored and handled without danger of bursting the pouch. Other materials will be typically liquid but could be solid or semi-solid, such as gel at refrigerated temperatures.

For filling the pouches, when used with coconut oil, it is preferable that the coconut oil be in liquid form and poured into the pouches and then allowed to set. The admixture of other oils can be used but to amounts which preferably do not interfere with the solid to liquid transition.

Coconut oil has been found to be particularly effective at treatment of hair and scalp conditions.

The treatment oil can include, but is not limited to: coconut oil, olive oil, argan oil, avocado oil, jojoba oil, kukiu oil, amla oil, and admixtures thereof.

The flexible package or pouch does not require opening, puncturing or piercing prior to inserting into microwave and does not vent during heating.

The apparatus contains an instruction material which instructs the consumer to insert the package into the microwave oven for the recommended time, then take the package out of the microwave, heat-check it at step 10A, open it at step 10B, and squeeze its warm oil contents onto their hair and scalp, massaging it in gently, for treatment purposes. A hair cap, plastic wrap or towel is then applied to the head and scalp and hair.

The package contains instruction material 16 printed on the package itself or on other associated material and contains instructions for the user to engage or knead the treatment material in the hands of the user as indicated at 10A to check for a required temperature, prior to the treatment material being applied at 10B.

The instruction material 16 contains instructions for the user to apply additional heat to the treatment material in additional increments if required, prior to the treatment material being applied.

Where a microwave is not available, the instruction material 16 contains instructions for the user to heat the treatment material in the flexible unopened pouch by submersing in hot water.

The pouch 10 includes an indication 18 of an opening location where the package is intended to be cut by the user. At that location, when cut, the flexible pouch can defines a built-in spout 20 of suitable dimensions to control the flow of the material out of the pouch and to enable the user to more easily direct the contents.

The flexible pouch is formed of a flexible plastics material 22 which is sealed and arranged to be kept sealed prior to inserting into the microwave oven. In particular the flexible pouch is a laminate of plastics layers comprising polyester film 22A and polyethylene film 22B so as to be foil free and Bisphenol A (BPA)-free and so as to provide an oxygen transfer rate (OTR) for it to be heated correctly and consistently in a microwave oven.

The flexible pouch includes a transparent window 24 at one location for viewing the contents and has the instruction material 16 reverse-printed inside of the laminate. For best aesthetic effect, the window is formed as part of a graphic of the printing on the package so that the absence of the printing ink at the window is used as a part of the attractive appearance.

In an alternative arrangement (not shown) the flexible pouch includes a re-sealable opening enabling the pouch to provide more than one portion or treatment for future use.

It is suggested the consumer leave the treatment material in for twenty minutes to 1 hour and as long as overnight for best results; at which point they shampoo and condition their hair to finish the treatment.

The purpose of warming the treatment material is to benefit the hair and scalp. For example, it is widely known that heat is desirable or more effective in order for oils and other formulas and conditioners to actually penetrate the hair shaft.

It is a single use, disposable, application package, which may or may not be re-sealable and may be formed of plastics materials selected so that they might also be recyclable.

There may be additional applications for the idea and method described above, such as microwaveable warmed/heated facial treatments (masques/masks) to promote healthy skin, anti-aging (wrinkles, skin elasticity, etc) as well as to help skin disorders such as psoriasis and eczema.

In such application, the contents of the flexible microwaveable package could contain but not be limited to: oils, formulas, lotions, creams, gels, pastes, serums, muds, clays, milk products such as coconut milk, honey, egg yolk and so on)

The invention can solve the problems:

The package can provide speed, convenience, and no mess. Traditionally the user would need to warm up treatment material such as oil in a pot or pan, or if using a microwave, a bowl or cup would be required. This also requires a jar or additional vessel container from which to source/extract the treatment material from, and using a spoon to do so. And one is faced with doing dishes afterwards as part of the clean-up, which of course requires a sink and detergent.

The invention eliminates virtually all of these steps; no jar or tube of treatment material (separate product), requiring no bowl, no spoon, no pots or pans, no sink, no dishes and no detergent. This clearly demonstrates the speed, convenience and "no-mess" of the invention.

The individual package treatments also solve other problems and provide additional benefits in other important ways to such as:

1) The package is travel-friendly in that it is much easier to travel with a flexible pouch or packet relative to a big jar or container of the material. In North America for example, most if not all hotel rooms do have microwaves, but they do not have pots, pans, bowls, mugs or spoons, rendering the former DIY traditional method useless.

2) The initial cost is reduced in that purchasing the single package treatment costs far less than purchasing a full container or jar of the treatment material.

Since various modifications can be made in our invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for application of a treatment material to head hair of a user comprising:

supplying the treatment material in a closed package containing the treatment material;

wherein the package is formed of a flexible plastics material which is impermeable and is impermeably closed or sealed around all edges to form a fully sealed pouch;

wherein the package includes reverse-printing of instructions information inside of the plastics material;

the package being formed of a laminate of plastic materials:

which is foil free;

which has an oxygen transfer rate (OTR) for it to be heated correctly and consistently in a microwave oven or in a hot water bath without bursting and without escape of the treatment material while the package remains sealed;

while the package remains sealed with the treatment material contained therein, warming the material in a microwave oven;

forming an opening in the package;

removing the warmed treatment material from the package;

and applying the removed warmed treatment material directly onto the head hair of the user.

2. The method according to claim 1 wherein the package is formed of a plastics material which is Bisphenol A (BPA)-free.

3. The method according to claim 1 wherein the package is formed of a laminate of polyester film and polyethylene film.

4. The method according to claim 1 wherein the treatment material comprises coconut oil which is solid at room temperature and is warmed to a temperature sufficient to melt the coconut oil to form a liquid.

5. The method according to claim 1 including the steps of forming a built-in spout formed at an opening in the package at a defined location and re-sealing the opening.

6. The method according to claim 4 including the steps of forming a built-in spout formed at an opening in the package at a defined location and re-sealing the opening.

7. The method according to claim 1 wherein the laminate of plastic materials is transparent and wherein the reverse printing is applied to cover the package apart from a transparent window in the package formed by omitting the reverse printing at the window.

8. The method according to claim 4 wherein the laminate of plastic materials is transparent and wherein the reverse printing is applied to cover the package apart from a transparent window in the package formed by omitting the reverse printing at the window.

9. The method according to claim 7 wherein the laminate of plastic materials is transparent and wherein the reverse printing is applied to cover the package apart from a transparent window in the package formed by omitting the reverse printing at the window.

* * * * *